US007071463B2

(12) United States Patent
Bowdler

(10) Patent No.: US 7,071,463 B2
(45) Date of Patent: Jul. 4, 2006

(54) CALIBRATION METHOD

(75) Inventor: Andrew R. Bowdler, Walsall (GB)

(73) Assignee: Kratos Analytical Limited, Manchester (GB)

( * ) Notice: Subject to any disclaimer, the term of this patent is extended or adjusted under 35 U.S.C. 154(b) by 220 days.

(21) Appl. No.: 10/388,586

(22) Filed: Mar. 17, 2003

(65) Prior Publication Data

US 2004/0024552 A1 Feb. 5, 2004

(30) Foreign Application Priority Data

Mar. 15, 2002 (GB) ..... 0206177

(51) Int. Cl.
*H01J 49/36* (2006.01)

(52) U.S. Cl. ..... 250/282; 250/287; 250/281

(58) Field of Classification Search ..... 250/281, 250/282, 287

See application file for complete search history.

(56) References Cited

U.S. PATENT DOCUMENTS 4,472,631 A * 9/1984 Enke et al. ..... 250/281
4,529,879 A * 7/1985 Schmit ..... 250/282
5,654,545 A * 8/1997 Holle et al. ..... 250/287

(Continued)

FOREIGN PATENT DOCUMENTS

| | | | |
|---|---|---|---|
| DE | 100 37 859 | A1 | 3/2002 |
| EP | 1 193 731 | A1 | 4/2002 |
| GB | 2 368 186 | A | 4/2002 |
| JP | 63079057 | A | 4/1988 |
| JP | 3081660 | A | 4/1991 |
| WO | 99/13492 | A1 | 3/1999 |
| WO | 00/70649 | A1 | 11/2000 |

OTHER PUBLICATIONS

Vlasak, P.R. et al., "Method for the Design of Broad Energy Range Focusing Reflectrons",Journal of the American Society for Mass Spectrometry, vol. 7, No. 10, (1996) pp. 1002–1008, Elsevier Science Inc., US.

Breen, E.J. et al., "Automatic Poisson Peak Harvesting for High Throughput Protein Identification", Electrophoresis, vol. 21, Jun. 2000, pp. 2243–2251, Wiley–VCH, Weinheim, Germaney.

Juhasz, P. et al., "The Utility of Nonspecific Proteases in the Characterization of Glycoproteins by High–resolution Time–of–flight Mass Spectrometry", International Journal of Mass Spectrometry and Ion Processes, vol. 169–170, (1997) pp. 217–230, Elsevier Scientific Pub. Co., Amsterdam, NL.

U.S. Appl. No. 09/946,838, filed Sep. 6, 2001, Bowdler.

L'Hermite et al, "A New Method to Study Metasable Fragmentation of Cluster Using a Reflectron Time–of–Flight Mass Spectrometer," Review of Scientific Instruments, American Institute of Physics, vol. 71, No. 5, May 2000, pages 2033–2037, XP012038274.

*Primary Examiner*—John R. Lee
*Assistant Examiner*—David A. Vanore
(74) *Attorney, Agent, or Firm*—Squire, Sanders & Dempsey LLP

(57) ABSTRACT

In its most general terms the invention compensates for the effect of the mass offset in the prior art calibration method. This can be achieved either by correcting for the offset or assigning mass to the peaks in such a way that the offset is avoided. Accordingly in a first aspect there is provided a method of calibrating a reflectron time-of-flight mass spectrometer using a spectrum generated by fragment ions wherein a measured mass value is modified to take account of the effect of post source decay and that modified value is used for calibration. A modified calibration function can then be defined and used to determine actual fragment ion masses of an unknown compound.

11 Claims, 8 Drawing Sheets

U.S. PATENT DOCUMENTS 5,760,393 A * 6/1998 Vestal et al. ..... 250/282
5,898,174 A * 4/1999 Franzen ..... 250/287
6,002,127 A * 12/1999 Vestal et al. ..... 250/282
6,188,064 B1 * 2/2001 Koster ..... 250/282
6,300,627 B1 * 10/2001 Koster et al. ..... 250/287
6,414,306 B1 * 7/2002 Mayer-Posner et al. .... 250/288
6,437,325 B1 * 8/2002 Reilly et al. ..... 250/252.1
6,469,295 B1 * 10/2002 Park ..... 250/282
6,534,764 B1 * 3/2003 Verentchikov et al. ..... 250/287
6,621,074 B1 * 9/2003 Vestal ..... 250/287
6,717,131 B1 * 4/2004 Holle et al. ..... 250/282
6,717,134 B1 * 4/2004 Bowdler ..... 250/287
6,717,135 B1 * 4/2004 Hansen ..... 250/287
6,737,643 B1 * 5/2004 Torti et al. ..... 250/288
2002/0033447 A1 * 3/2002 Bowdler ..... 250/282
2004/0024552 A1 * 2/2004 Bowdler ..... 702/89
2004/0065824 A1 * 4/2004 Bateman et al. ..... 250/288
2004/0079880 A1 * 4/2004 Bateman et al. ..... 250/288
2004/0089800 A1 * 5/2004 Jackman ..... 250/282

* cited by examiner

CALIBRATION METHOD

BACKGROUND TO THE INVENTION

This invention relates to a method for calibrating a mass spectrometer. In particular, this invention relates to a method for calibrating a mass spectrometer using the mass spectrum of daughter or fragment ions produced by post-source decay of a meta-stable ion in a reflectron time-of-flight (TOF) mass spectrometer.

In a TOF mass spectrometer, meta-stable ions (also referred to as pre-cursor ions) are generated in an ion source from a sample and repelled from the source into a drift region. In the drift region, these meta-stable ions may break into fragments in a process known as post-source decay. Alternatively, post-source decay may be induced by laser or within a collision cell to produce fragment ions. These fragment or daughter ions are useful for determining the structure of the sample from which the meta-stable ions are generated. For example, in the case of a peptide sample, these daughter ions are related to the amino acid composition of the sample molecule and can therefore be used to deduce sequence information.

In this specification the terms parent ion, meta-stable ion and pre-cursor ion will be used interchangeably as will the terms daughter ion and fragment ion.

When analysing a sample by normal TOF mass spectrometry i.e. with or without a reflectron, the user is presented with data relating to the time that the ions have taken to travel through the drift region. The time taken is dependent on the mass to charge ratio of the ion. In order to convert the time of flight data into the more useful mass data, it is necessary to calibrate the mass spectrometer using a spectrum of a known compound in which the molecular identity and therefore the molecular weight of the ions observed is known. In this way it is possible to correlate flight time and molecular weight so that on analysing an unknown compound, it possible to assign weights to the unknown peaks on the basis of the flight time for the peak.

In a reflectron TOF mass spectrometer, the daughter ions formed in post-source decay are separated according to their velocity and according to their energy (which is related to their mass); whereas normal, parent ions all have approximately the same energy (having been accelerated by the same potential) and are separated according to their velocity only. Therefore the mass calibration for the daughter ions is not the same as for the normal (original meta-stable) ions.

Ions which undergo post source decay (PSD) do so (by definition) in the field free region. Thus ions that fragment in the source or the reflectron are not detected in the PSD fragment spectrum—either because they are selected out or do not reach the detector in time focus. Because there are no external fields (no external forces on the ions) momentum is conserved and all the fragments retain the velocity of the pre-cursor ion i.e., the velocity with which it left the ion source. The kinetic energy of the ions is given by the following equations:—

| | |
|---|---|
| Pre-cursor ion: | $E_p = \frac{1}{2} m_p v_p^2$ |
| Fragment ion: | $E_f = \frac{1}{2} m_f v_p^2$ |

(where $E_p$ = Kinetic energy of precursor ion,
$E_f$ = kinetic energy of fragment ion,
$m_p$ = mass of precursor ion,
$m_f$ = mass of fragment ion and
$v_p$ = velocity of precursor ion).

Thus it follows that the ratio of the mass of a fragment ion to that of the pre-cursor is the same as the ratio of their kinetic energies:

$$m_f/m_p = E_f/E_p$$

In a linear time-of-flight mass spectrometer we can see that because the velocities of the fragment and pre-cursor ions are the same there is no way of distinguishing between them—they arrive at the detector at the same time and therefore have the same measured mass.

In a reflectron time-of-flight mass spectrometer ions encounter a retarding field in the reflectron and travel into the reflectron to the point where their potential energy equals their kinetic energy. The ions are then turned around and reflected back out to emerge from the reflectron with the same speed but in the reverse direction. The reflectron is an energy analyser and can thus distinguish between pre-cursor ions and fragment ions and also fragment ions of different mass. This is the principle of fragment mass analysis in a reflectron time-of-flight mass spectrometer whatever type of reflectron is used. It applies to linear field reflectrons, where the voltage is stepped or scanned over multiple experiments in order to build up a complete fragment spectrum and also to curved field or quadratic field reflectrons which allow the fragment spectrum to be acquired in one shot.

The calibration of the time of flight spectrum for fragments is not the same as that of the pre-cursor ions. In the normal pre-cursor ion spectrum the ion energy is essentially the same for all mass whereas for the fragment ions there is a dependence of the ion energy on mass for the flight time in the reflectron. It is possible to calculate the calibration function for the fragment ions and relate this to the normal calibration function for the pre-cursor ions. Usually, the fragment mass calibration will depend on the ratio of the fragment mass with respect to the pre-cursor ion mass. However, for best mass accuracy and for practical reasons a calibration will be based typically on a fragment mass spectrum of a known compound. Typically a single known compound which gives rise to eight or so known fragments (of known masses) is used.

In the example of a curved field reflectron the basic calibration function has a form as follows. The actual mass, $m_{act}$ of the fragment ion can be related to the apparent mass, $m_{app}$ that would be measured using the normal mass calibration (i.e., that of the pre-cursor ions). The ratio $m_{act}/m_{app}$ follows a curve which depends only on the ratio of $m_{act}$ to the pre-cursor mass, $m_{pre}$. By knowing the $m_{act}$ for a standard compound and measuring the $m_{app}$ the calibration curve can be defined for all pre-cursor masses. An example of such a curve is shown in FIG. 1. It can be seen from FIG. 1 that if the fragment has the same mass as the precursor ion, the apparent measured mass will be the same as the real mass. If however the fragment ion's actual mass is less than the precursor ion, the apparent measured mass ($m_{app}$) of the fragment ion will be greater than its actual mass ($m_{act}$). In FIG. 1 the apparent mass of the fragment ion is approximately 1.4 times its actual mass when the actual fragment mass is 10% of the precursor ion mass. The exact shape of the calibration curve will be different for each spectrometer depending upon the reflectron and drift tube dimensions.

The inventors have realised that conventional methods of calibrating for PSD fragments in a reflectron mass spectrometer introduce errors into the calibration and lead to inaccurate mass measurement. This is due to a complication caused by the fact that the parent meta-stable ion has a natural isotope distribution, for example, from the natural abundance of carbon 13 isotopes in the molecule. The current invention provides a method of correcting for or avoiding these errors.

The errors and a method of correcting for or avoiding them are explained below.

Many atoms have more than one stable (non-radioactive) isotope, i.e., differing in the number of neutrons within the nucleus. The most common example is that of carbon $^{12}C$ which has 6 protons and 6 neutrons giving a nominal mass of 12 Da but has a stable isotope with 7 neutrons, denoted $^{13}C$ and a mass of 13Da. The $^{13}C$ isotope has a natural abundance of 1.1% so that on average just over 1 in 100 carbon atoms is $^{13}C$. Similar behavior is seen for nitrogen, oxygen and sulphur. All of these atoms are present in significant quantities in organic molecules such as peptides and proteins so that the mass spectrum will show not one single peak but a distribution of peaks 1 Da apart according to the size of the molecule and the natural abundance of the isotopes of the atoms that make it up.

FIG. 2 shows the mass spectrum of the insulin b-chain. It can be seen that there are several peaks, each 1 Da (Dalton) apart due to the presence of isotopes in the insulin b-chain sample.

Similarly, fragment molecules also show isotope distributions. However the inventor has noticed that the separation of isotopic peaks in the fragment ion are not separated by 1 Dalton. The inventor has studied this phenomena and devised a method of spectrometer calibration and PSD fragment mass measurement which takes this into account and thus is more accurate than the prior art. This phenomena which has not previously been noticed, is described in more detail below.

The higher mass isotopes will be distributed randomly throughout the pre-cursor molecule and, in the absence of any unusual chemical effects, the higher mass isotopes will also be randomly distributed within the fragment molecule. When the fragmentation process occurs molecules with higher mass isotopes can therefore only form fragment ions with up to the same number of higher mass isotopes (but not more!).

In post-source decay this has a significant effect on the mass accuracy because fragments with the same number of higher mass isotopes (and therefore the same mass) can be produced by a pre-cursor with differing numbers of higher mass isotopes. For example, one parent ion will have a natural carbon 13 abundance and as this ion decays some daughter ions will contain only carbon 12 whilst other daughter ions will contain varying percentages of carbon 13.

FIG. 3 shows how fragments with the same number of higher mass isotopes can be produced by precursor ions with differing numbers of higher mass isotopes. In the interests of clarity FIG. 3 only considers the $^{13}C$ carbon isotope which is the most significant isotope for organic compounds.

The top part of FIG. 3 shows the isotopic distribution of the parent ion, there are four peaks and each peak represents a parent ion with a different number of isotopes. The first peak 1 represents the mono-isotopic parent ion in which all of the carbon atoms are $^{12}C$ atoms. The second peak 2 represents a parent ion containing only one $^{13}C$ isotope. The third peak 3 represents a parent ion containing two $^{13}C$ isotopes and the fourth peak 4 represents a parent ion containing three $^{13}C$ isotopes. The peaks are equally spaced and 1 Dalton apart from each other, so as shown in FIG. 3 the mass of the first peak is Mp Daltons (where Mp is the mono-isotopic mass of the parent ion), the second peak mass is (Mp+1) Daltons, the third peak (Mp+2) Daltons and the fourth peak (Mp+3 Daltons).

The bottom part of FIG. 3 shows the isotopic distribution of a fragment ion originating from the precursor ion shown at the top of the FIG. 3. The distribution is shown by four peaks, again each peak represents a fragment ion containing a different number of $^{13}C$ isotopes. The first peak 5 represents the mono-isotopic fragment ion which contains $^{12}C$ atoms only and no isotopes, the second peak 6 represents a fragment ion which contains one $^{13}C$ isotope only, the third peak 7 represents a fragment ion which contains two $^{13}C$ isotopes and the fourth peak 8 represents a fragment ion which contains three $^{13}C$ isotopes. The actual mass of the ion represented by the first peak 5 is Mf Daltons (Mf=the mono-isotopic mass of the fragment ion), the actual mass of the ion represented by the second peak 6 is (Mf+1) Daltons, (Mf+2) Daltons for the third peak 7 and (Mf+3) Daltons for the fourth peak 8. In a real mass spectrometer the measured masses and generated mass spectrum will be different as is explained later.

The arrows between the top and the bottom parts of FIG. 3 show the relationship between the isotopic distributions of the fragment and precursor ions. It shows which isotopic fragment ions can be produced by which isotopic precursor (parent) isotopic ions.

The mono-isotopic fragment ion 5 can be produced by any of the isotopic forms of the parent ion 1, 2, 3 or 4 as all of these will contain $^{12}C$ atoms.

The first isotopic fragment ion 6 cannot be produced by the mono-isotopic parent ion (as the mono-isotope does not contain any $^{13}C$ atoms), but can be produced by any one of the non-mono-isotopic parent ions 2, 3, or 4.

The second isotopic fragment ion 7 can be produced by any parent ion which contains at least two $^{13}C$ atoms, i.e. by the second and third parent ion isotopes 3 and 4.

The third isotopic fragment ion 8 can only be produced by a parent ion having at least three $^{13}C$ atoms, i.e. only by the third isotopic parent ion 4.

The measured mass of each fragment ion isotope will depend upon the parent isotope which it came from. As the ratio $m_{act}/m_{pre}$ (the ratio of actual fragment ion mass to precursor ion mass) is different for each parent isotope, the calibration curve is slightly different and hence the measured mass will also be slightly different.

The difference in measured mass depends on the type of reflectron and the dimensions of the mass spectrometer but is finite for all instruments. It can be described as an offset in mass $m_o$ such that the difference between the actual and measured mass of the fragment ion is $m_o \times n$ Daltons (Da) where, $m_0$ is a mass offset parameter and n is extra mass (in Daltons) of the higher mass isotopic parent ion. (In the example of FIG. 3, n is the number of $^{13}C$ atoms contained in the parent).

This mass offset effect can influence the mass measurement accuracy in two ways. Firstly, it leads to a broadening of the mass peak which effectively reduces mass resolution of the measurement. Secondly, the measured separation of the isotope peaks is not 1 Da but actually $(1+m_o)$ Da, where $m_0$ is a parameter characterizing the mass offset. These effects are illustrated in FIG. 4 and FIGS. 5*a* and 5*b*.

FIG. 4 shows this mass offset effect for the fragment ions resulting from a sample containing the parent ions 1 and 2 of FIG. 3.

The top part of FIG. 4 shows the mass spectrum which will be generated in the spectrometer by the parent ions. The first peak 10 is the mono-isotopic peak (generated by a parent ion 1 in which all the carbon atoms are $^{12}C$ atoms) and the second peak 11 is the peak resulting from a parent ion 2 which has the same chemical formula as the parent ion 1, but in which one of the carbon atoms is a $^{13}C$ atom.

The bottom part of FIG. 4 shows the peaks which will be generated in the spectrometer by the fragment ions. The first peak 20 is the mono-isotopic peak. The mono-isotopic peak is the peak generated by a mono-isotopic fragment ion which originated from a mono-isotopic parent ion. This relationship with the mono-isotopic parent ion is shown in FIG. 4 by an arrow pointing from the mono-isotopic parent peak 10 to the fragment ion's mono-isotopic peak 20.

The second peak 21 is the peak generated by a mono-isotopic fragment ion originating from a parent ion having one $^{13}C$ atom amongst its carbon atoms. The actual mass of the fragment ion generating the peak 21 is the same as the actual mass of the fragment ion which generates the mono-isotopic peak 20, however its measured mass is greater because the ratio of the parent mass to the fragment is different.

The measured mass of the fragment ion which generates the mono-isotopic peak 20 is the same as its actual mass: Mf; the ratio of pre-cursor (parent) ion mass to actual fragment ion mass is Mp/Mf.

The actual mass of the fragment ion which generates the second peak 21 is also Mf, but its measured mass is $Mf+m_0$; the ratio of pre-cursor to actual fragment mass for this fragment ion is Mp+1/Mf. As there are two peaks relating to the same actual mass fragment ion, the resolution of the spectrometer for fragment ions is reduced.

The third peak 22 shown at the bottom part of FIG. 4 is generated by a fragment ion containing one $^{13}C$ isotope which originated from a parent ion containing one $^{13}C$ isotope. The vertical dashed line in FIG. 4 shows the point 1 Dalton away from the mono-isotopic peak 21. It can be seen that due to the above described offset effect the spacing of the mono-isotopic peak 20 from the peak 22 is not 1 Dalton, but $(1+m_0)$ Daltons. The value of $m_0$ depends upon other things on the type and size of the reflectron used.

This mass offset effect is a consequence of the fact that a fragment ion cannot have more higher mass isotopes than were in the pre-cursor ion that produced it. The effect is to shift the average of the mass distribution to higher mass by an amount depending on the abundance of higher mass isotopes in the pre-cursor ion and the size of $m_o$.

While the offset effect has been described above with regard to the $^{13}C$ isotope, it is not just carbon which produces this effect but also other isotopes such as nitrogen 15 and isotopes of oxygen and sulphur.

FIG. 5*a* is a mass spectrum showing the isotopic distribution of fragment ions without the mass offset effect (i.e. $m_0=0$). FIG. 5*b* is a mass spectrum of the same fragment ions when the mass offset is $m_0=0.25$. FIGS. 5*a* and 5*b* were generated by a computer model. It can be seen that the offset skews the shape of the mass spectrum towards the heavier masses.

While the above has been discussed in relation to a 'mass offset', it will be clear to a person skilled in the art that this could also be termed a 'time of flight offset' as mass need only be assigned to the various times of flight of the fragment ions at the end of the calibration process. The above discussion has assumed that the times of flight of the fragment ions are first converted to mass according to the parent ion calibration and then adjusted according to a calibration curve, e.g. such as that shown in FIG. 1. However it would also be possible to work in time of flight and to adjust the time of flight of the fragment ions with a similar calibration curve before finally assigning a mass at the end of the calibration process. However the above principles remain the same whether working in time of flight or mass.

It is possible to use a "smoothing" technique on the fragment mass isotopic distribution but this may lead to an error in the mass assignment as smoothing involves selection of a peak (usually the most abundant peak) and the centering of the distribution on this peak using an algorithm. In practice this smoothing leads to an averaging of the mass peaks in the distribution pattern, this average usually being distorted from the accurate mass by the higher mass isotope peaks within the distribution.

The following invention aims to ameliorate the above problems.

BRIEF SUMMARY OF THE INVENTION

In its most general terms the invention achieves this by compensating for the effect of the mass offset in the calibration method. This can be achieved either by correcting for the offset or assigning mass to the peaks in such a way that the offset is avoided.

Accordingly, in a first aspect there is provided a method of calibrating a reflectron time-of-flight mass spectrometer using a spectrum generated by fragment ions wherein a measured mass value is modified to take account of the effect of post source decay and that modified value is used for calibration.

Preferably the measured mass value which is modified is the measured average mass.

The measured mass value may be modified by adjusting for the effect of the mass offset.

As was shown in relation to FIG. 5, when the mass offset ($m_0$) is significant, the individual isotope peaks become spread out in mass depending on the isotope of the pre-cursor ion from which they originated. In situations where it is not possible to see the individual isotope peaks, for example due to limited mass resolution, then a broad distribution is measured instead and the mass which may be determined is most likely to be an average value. This average mass will be affected by the width of the distribution, which in turn depends on $m_0$ combined with the pre-cursor isotope distribution.

According to one implementation of the first aspect, the method involves the step of determining the shift in average mass $\delta m_{av}$ as a function of $m_0$, $m_f$ and $m_p$ and the step of applying that function as a correction to the experimental results from the real samples as measured in the mass spectrometer.

The two steps above may be carried out directly after each other, or the first step may be carried out in advance, and the second step carried out at a later point in time.

For example, since the first step is effectively a calibration step, it can be carried out well in advance of any experiment. This first step may be carried out on a separate computer or instrument from the spectrometer, for example during the design process or on a prototype instrument.

The second step is effectively applying the results of the calibration to correct the mass, and therefore is preferably carried out with analysis software on the instrument collecting the mass data at the time of any experiment.

For a constant $m_0$, the shift in the average mass may be independent of fragment mass. Furthermore, preferably the mass shift depends directly on the value of $m_0$ and the number of carbon atoms nCp in the parent ion, such that:

$$\delta m_{av}=m_0\times(nCp/100).$$

The calibration method is preferably carried out using a sample which undergoes post-source decay into fragment ions of known molecular identity.

Accordingly in a second aspect, there is provided a method of analysing a spectrum of fragment ions generated by a reflectron time-of-flight mass spectrometer wherein a measured mass value is modified to take account of the effect of post source decay, that modified value is used to define a calibration function, and that calibration function is used to determine actual fragment ion masses of an unknown compound.

The measured mass value is modified according to any of the methods described in relation to the first aspect of the invention.

Preferably, this method of analysing is preceded by a calibration step using the calibration method according to the first aspect of the present invention. Thus both in the calibration of the spectrometer and its subsequent use in measuring fragment masses, the modification of the measured mass value is used to correct the mass of the fragment ion.

In a third aspect there is provided a calibration apparatus for use in a mass spectrometer, the calibration apparatus including:

means for modifying a measured mass value to take account of the effect of post source decay;

and means for defining a calibration function for a known compound using that modified value.

The means for modifying a measured mass value can use any of the methods described in relation to the first aspect of the invention.

In particular, the means for modifying a measured mass value determines the effect of the mass offset on the average mass and that information is used by the means for defining a calibration function.

Preferably, the calibration apparatus also includes display means for displaying the mass spectrum showing the distribution pattern(s) of the fragment ion(s). There may also be means for receiving the spectrum data from a mass spectrometer and/or means for outputting calibration data to a mass spectrometer.

Preferably, the calibration apparatus includes a microprocessor programmed with suitable software.

In especially preferred embodiments, the calibration apparatus is integral with the mass spectrometer.

In a fourth aspect there is provided a reflectron time-of-flight mass spectrometer including calibration means according to the third aspect of the present invention.

The mass spectrometer may be any reflectron time-of-flight mass spectrometer irrespective of the shape of the static field in the reflectron. For example, the spectrometer may have a curved field, a quadratic field or a linear field (e.g. a single or dual sloped field) applied to the reflectron. Additionally, the spectrometer may have a reflectron where the voltage is applied as a single pulse or in a scanning mode.

The two essential steps of the calibration method according to the invention can be characterised as a calibration step (also referred to as the "first step" above), in which the calibration function is defined, and an application step (also referred to as the "second step" above), in which the defined calibration function is applied to unknown data.

The correction of the effects of mass offset can also be carried out using one of these steps in conjunction with an alternative way of performing the other step.

In particular, the alternative way of performing the other step may be as described below. Whilst this method will be described in its entirety, it will be appreciated that this invention only relates to the use of either the calibration step or the application step of this method, in combination with the other step as described in relation to the above aspects of the invention. The method below is the subject of a separate patent application (U.S. application Ser. No. 09/946,838), which is herein incorporated by reference.

It will further be appreciated that the other aspects of the invention described above may also use one step as described in the method below in combination with the other step as described above.

Accordingly there is provided a method of calibrating a reflectron time-of-flight mass spectrometer using a spectrum generated by fragment ions wherein the mass of the fragment ion is assigned using the mono-isotopic peak only. In other words a value corresponding to the mass of the fragment ion used for calibration is assigned using the fragment ion mono-isotopic peak only and said value is used to calibrate the spectrometer.

Typically the spectrum will have a plurality of peaks, which may be termed as mass peaks or time of flight peaks depending (as discussed above) on whether the time of flight has been converted to mass.

In this context the mono-isotopic peak is the peak corresponding to the fragment ion containing only the most naturally abundant isotopes of each element and originating from a parent ion containing only the most naturally abundant isotopes of each element—i.e. the mono-isotopic fragment peak is the peak generated by a mono-isotopic fragment originating from a mono-isotopic precursor ion. In practice this will be the lowest mass peak in the distribution pattern. For example in the fragment spectrum shown in FIG. 5*b* the mono-isotopic peak is the peak labelled 100 and having a mass of 1084 Daltons.

By selecting the mono-isotopic peak only, the characteristics of the daughter ion isotope distribution (and the mass offset) are prevented from affecting the calibration process thus improving mass accuracy of the daughter ions.

The mono-isotopic peak can be determined by inspection if the individual isotopic peaks are sufficiently resolved (e.g. as in FIG. 5*b*).

Alternatively the mono-isotopic peaks can be determined by an algorithm. This can be particularly useful if the isotopic peaks are not fully resolved. Several algorithms which are capable of determining the mono-isotopic peak even when the isotopic peaks are not resolved. Many such algorithms assume that the separation of the isotopic peaks is 1 Dalton.

Preferably the algorithm is adapted to take into account the mass offset caused by the isotopic distribution of the parent ions. Most preferably this involves use of the mass offset parameter $m_0$ which is described above. Typically this will involve the algorithm calculating the separation of the isotopic peaks according to the formula isotopic peak separation=$(1+m_0)$ Daltons, where $m_0$ is a mass offset parameter which depends upon the spectrometer and reflectron used. This formula is an approximation, because as will be appreciated the mass offset leads to numerous isotopic peaks, some of which have a separation of less than 1 Dalton. However the algorithms generally work assuming that the isotopic distribution has no mass offset (e.g. as shown in FIG. 5*a*) and that the peaks are separated by 1 Dalton and therefore the $(1+m_0)$ Daltons formula is a good approximation for the purposes of the mono-isotopic peak finding algorithm. This is because each isotopic form of the fragment ion will give rise to a plurality of peaks (one for each possible parent isotopic ion) and the highest peaks in these pluralities will generally be separated by $(1+m_o)$ Daltons.

The calibration method is preferably carried out using a sample which undergoes post-source decay into fragment ions of known molecular identity.

In preferred embodiments, the parent ion peak i.e. the peak corresponding to the original, unfragmented metastable ion is also assigned in the calibration method. Preferably the mass of the parent ion is assigned by using only the mono-isotopic parent peak.

There is also provided a method of analysing a spectrum of fragment ions generated by a reflectron time-of-flight mass spectrometer wherein the mass of the fragment ion is assigned using the mono-isotopic peak only.

The mono-isotopic peak may be determined according to any of the methods described above.

The methods described above can be applied to a spectrum generated by any reflectron time-of-flight mass spectrometer irrespective of the shape of the static field in the reflectron. For example, the method is applicable to a reflectron time-of-flight mass spectrometer where the shape of the electrostatic field on the reflectron is a curved field, a quadratic field or a linear field (e.g. a single or dual sloped field). Additionally, the methods can be used for spectra generated in cases where the voltage on the reflectron is applied as a single pulse or in a scanning mode.

Embodiments of the invention will now be described with reference to the accompanying figures.

SUMMARY OF FIGURES

FIGS. 1–5*b* have been described above.

DETAILED DESCRIPTION OF THE INVENTION

Figure 1:
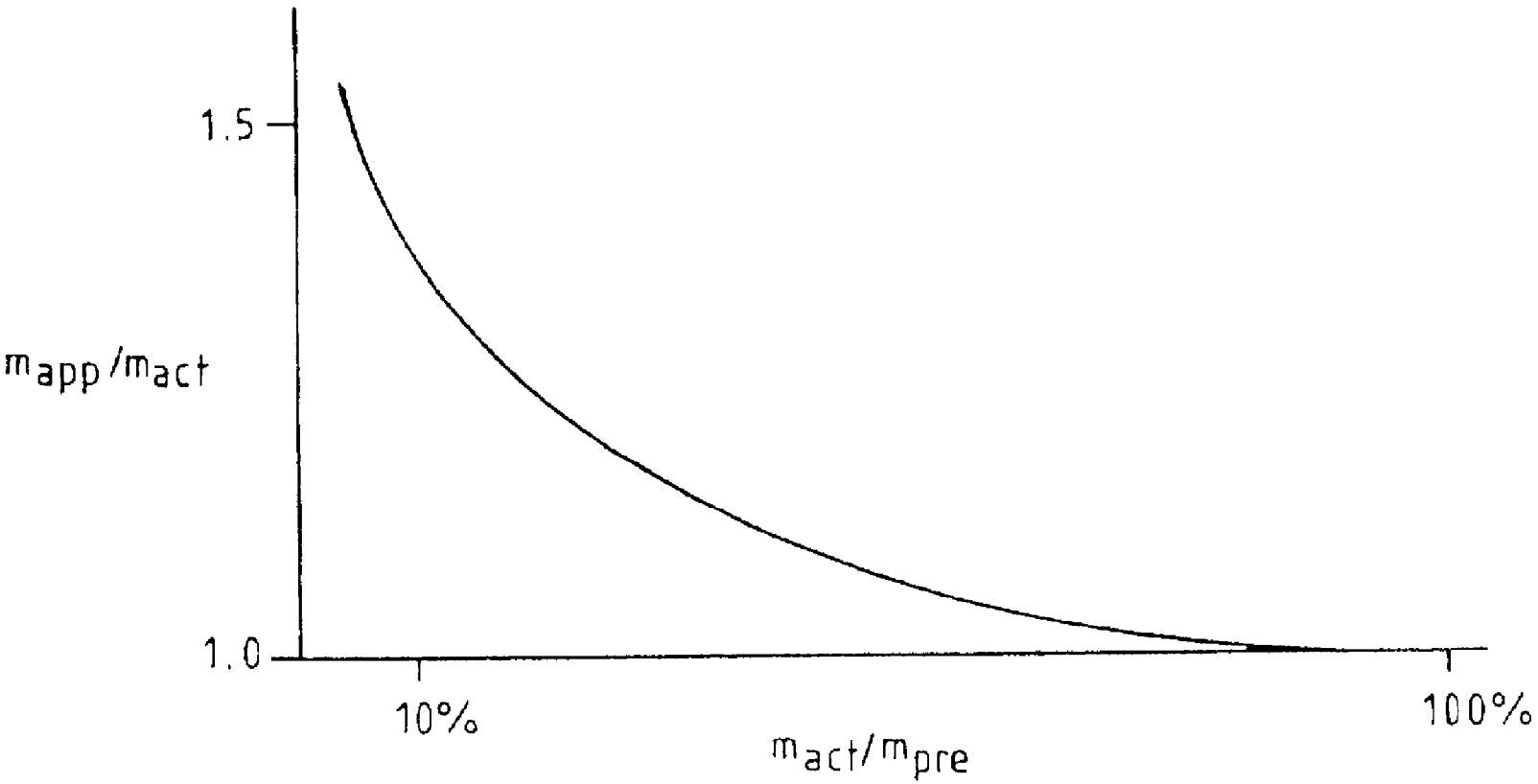
FIG. 1 has already been described.
Figure 2:
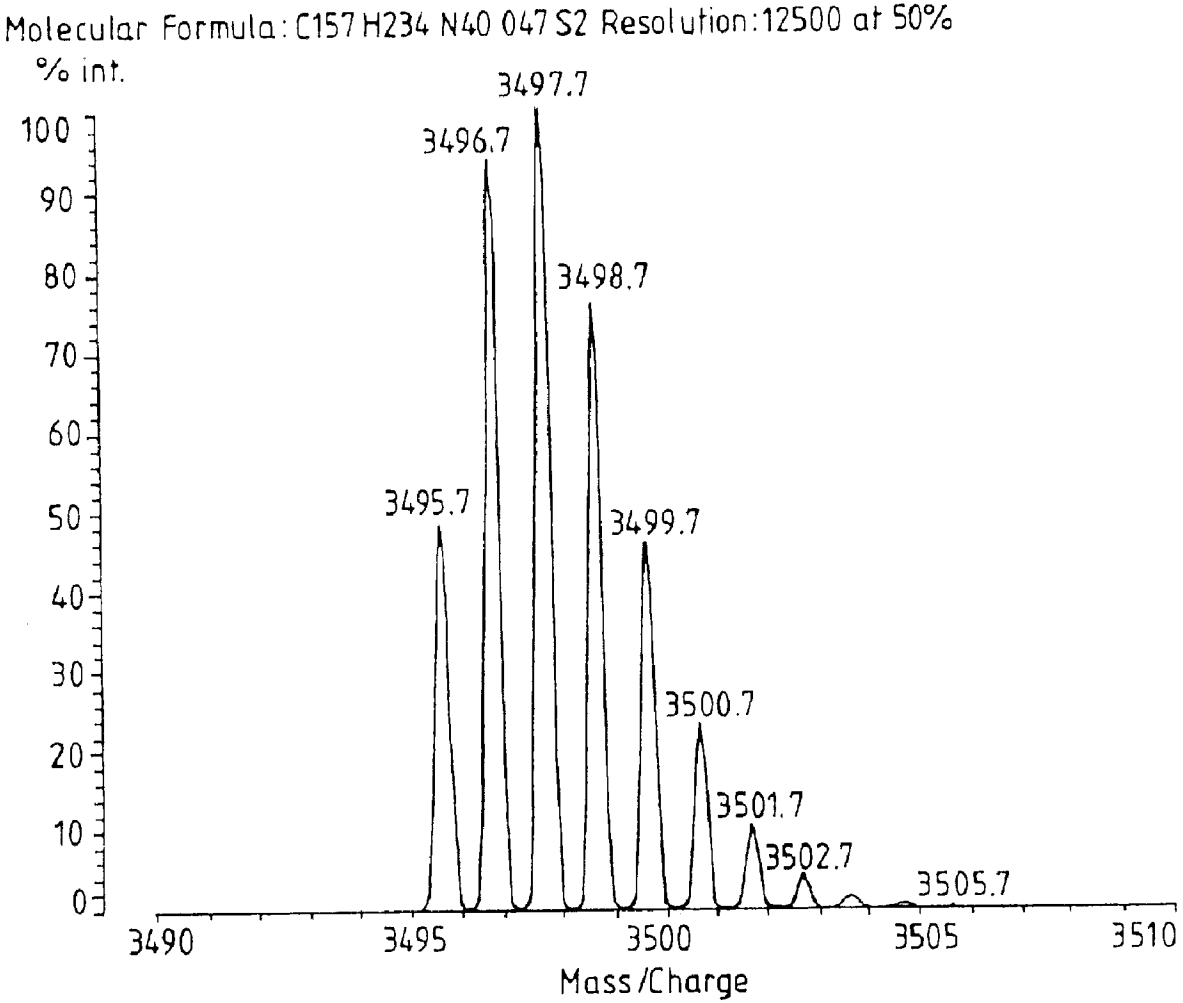
FIG. 2 shows the mass spectrum of the insulin b-chain.
Figure 3:
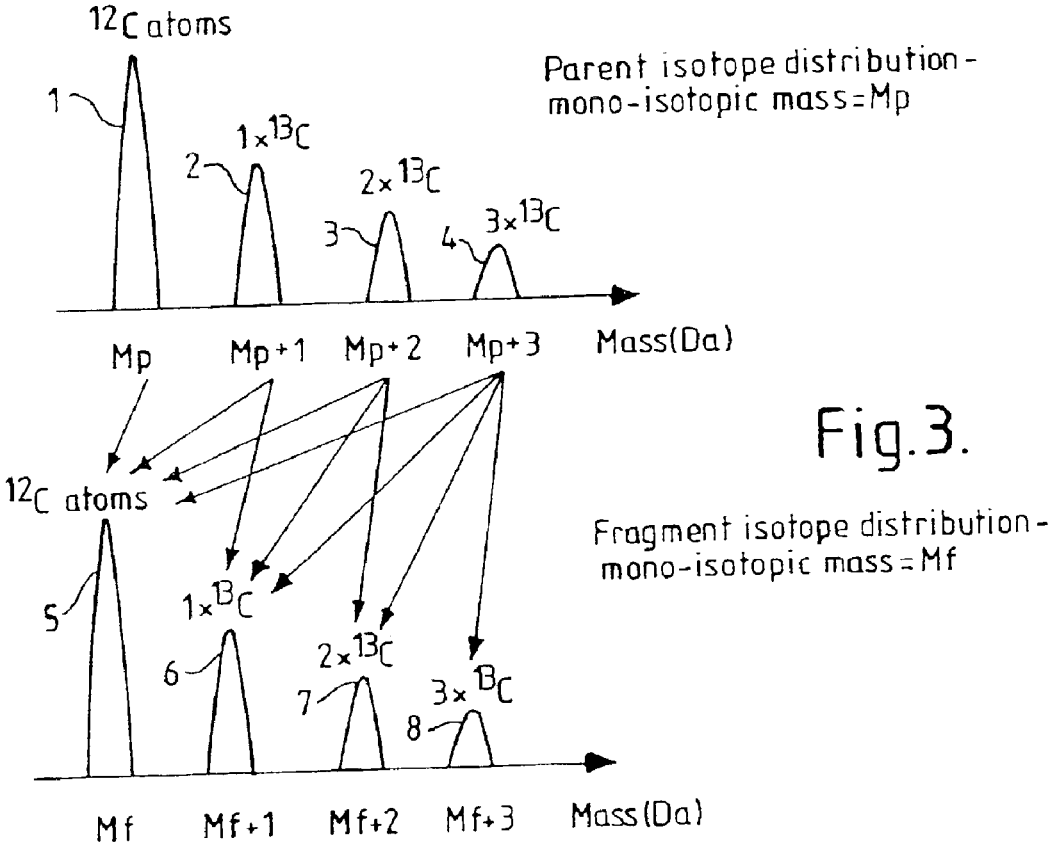
FIG. 3 illustrates the relationship between the parent isotope and fragment isotopes.
Figure 4:
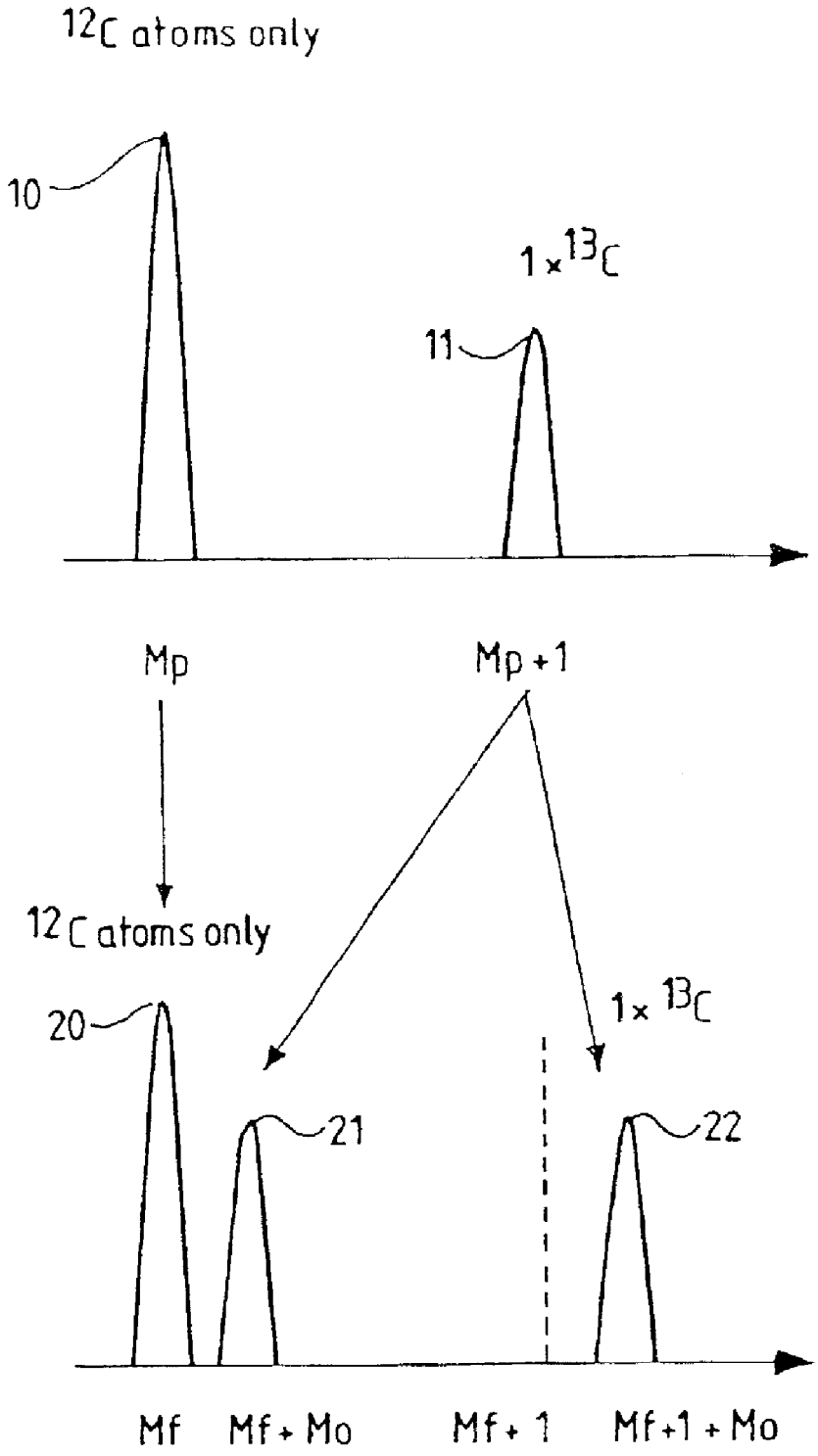
FIG. 4 illustrates how a mass offset effect can occur due to the isotopic distribution of the precursor ion.
Figure 5A:
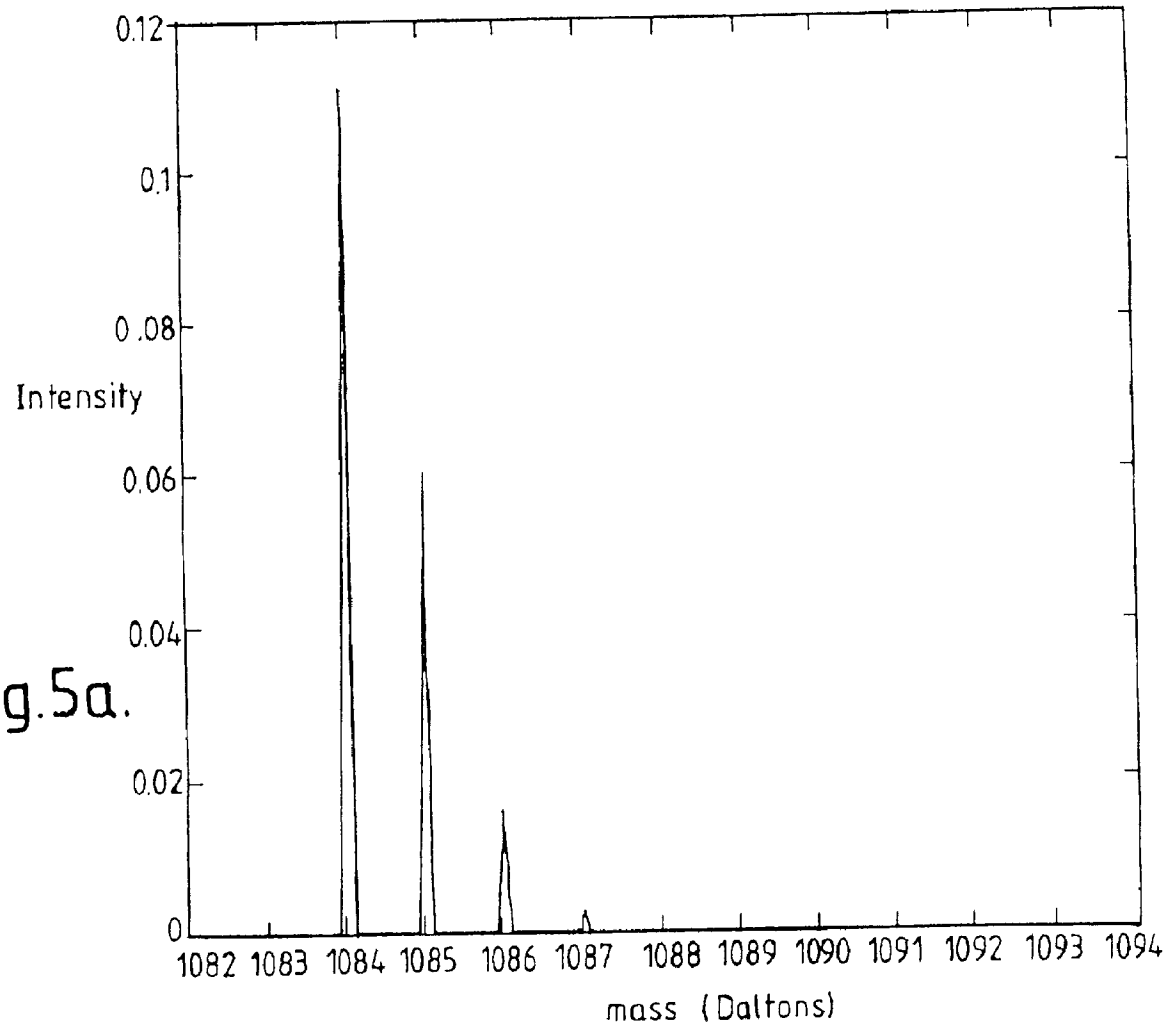
FIG. 5*a* shows an example of a fragment ion mass spectrum with no mass offset ($m_0$=0)
Figure 5B:
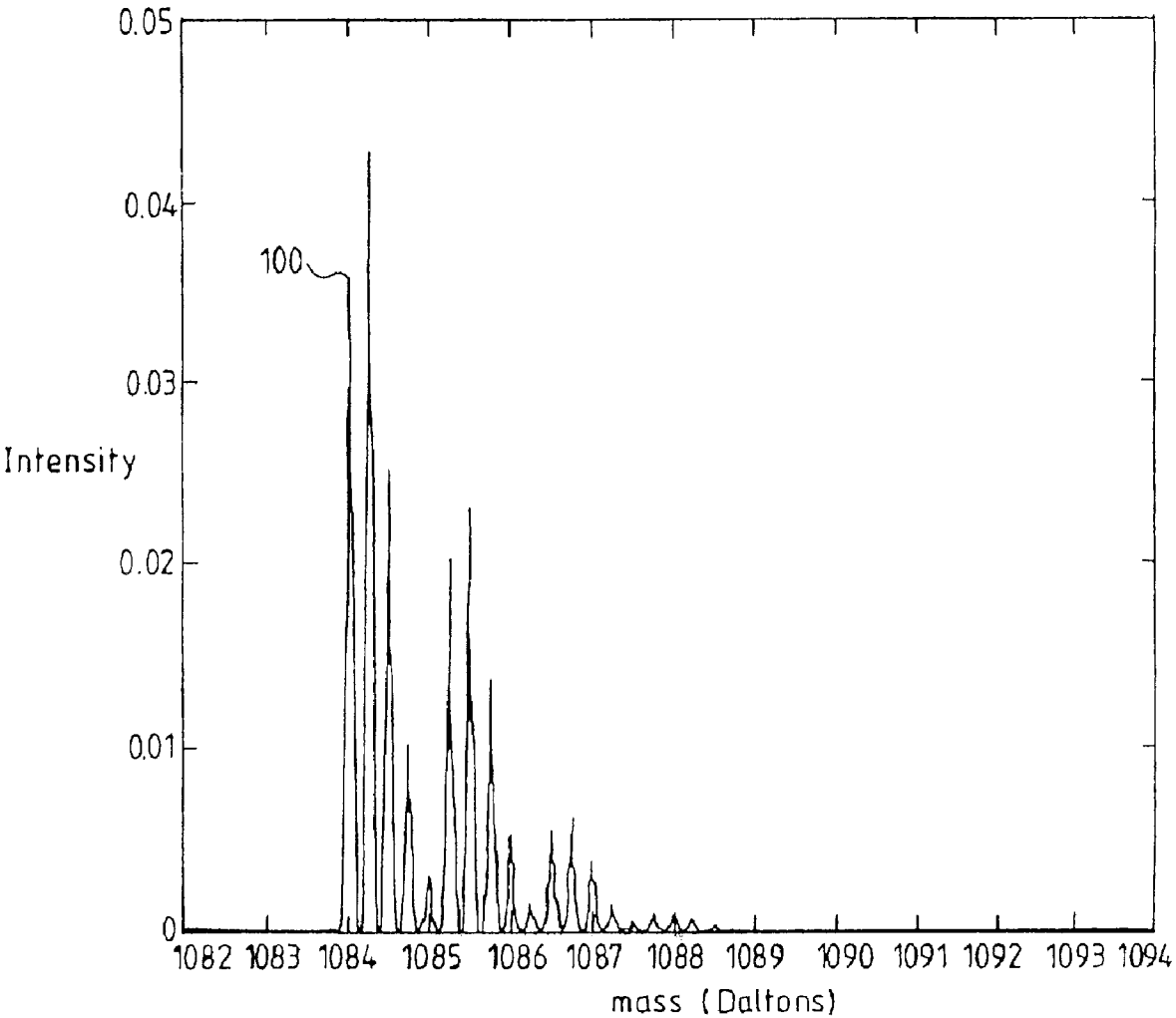
FIG. 5*b* shows an example of a mass spectrum for the same fragment ion as FIG. 5*b* but with a mass offset set at $m_0$=0.25, ($m_0$ is a parameter which determines the mass offset)

A PSD reflectron mass spectrometer is provided with calibration software for calibrating the spectrometer and mass assignment software for assigning the mass of unknown peaks once the spectrometer has been calibrated.

The spectrometer is calibrated for parent ions by analysing a compound of known molecular identity and assigning masses to the observed peaks on the basis of the known molecular identity of the compound. In this way time of flight is correlated with molecular weight and so when an unknown compound is analysed by the spectrometer the unknown peaks can be assigned masses based on this correlation.

Three ways of calculating the mass offset parameter $m_0$ will now be described. $M_0$ depends on the spectrometer and type of reflectron used.

$M_o$ can be calculated from knowledge of the flight times of three ions as follows:

The time of flight of the mono-isotopic fragment ion mass $m_f$ produced from the parent ion of mono-isotopic mass $m_p$ written: TOF($m_f$, mp).

The time of flight of the mono-isotopic fragment ion mass $m_f$ but produced from the first isotope (i.e. containing a single $^{13}C$ atom) of the parent mass $m_p$+1 written: TOF($m_f$, $m_p$+1).

The time of flight of the fragment mass $m_f$+1 from the mono-isotopic parent mass $m_p$ is TOF($m_f$+1,$m_p$).

The difference in flight time for fragment ions differing in mass by 1 Da, from the same mass pre-cursor ion is $$\Delta TOF_f = TOF(m_f+1, m_p) - TOF(m_f, m_p)$$

The difference in flight time for the mono-isotopic fragment from two pre-cursor isotopes 1 Da apart is $$\Delta TOF_p = TOF(m_f, m_p+1) - TOF(m_f, m_p)$$

The fragment mass offset, $m_o$ is simply the ratio of these two times:

$$m_o = \Delta TOF_p / \Delta TOF_f$$

The flight times of the pre-cursor and fragment ions (preferably at least three ion masses are needed) may be determined in several ways for example:

1. By constructing an ion trajectory model of a reflectron ToF mass spectrometer and measuring the time of flight of the ions simulated in the model.
2. By calculating the time of flight of the different ions explicitly using the equations of motion of ions in the electric fields as produced by a reflectron ToF mass spectrometer
3. By measuring experimentally using a reflectron ToF mass spectrometer with appropriate mass resolution on PSD data with compounds giving suitable isotope distributions.

The first two methods of calculating time of flight have been described in publications by the inventor for example A Bowdler and E Raptakis, 47$^{th}$ ASMS Conference on Mass Spectrometry and Allied Topics, June, 1999.

An example of method 2 will now be provided.

If we consider PSD of the molecule insulin B chain, mass 3496.7 Da and its fragment at 1086.6 Da. The time of flight for a reflectron ToF MS of the 1086.6 Da fragment is 39.672 μs where ions are generated in the ion source at 20 kV, the length of the flight tube is 1.2 m and a curved field reflectron of length 0.365 m is used. In this case $\Delta TOF_f$ is 0.0105 μs and $\Delta TOF_p$ is 0.0024 μs so that $m_o$ is about 0.24 Da.

The same calculation can be made where the reflectron is a linear field (single stage) reflectron of length 0.2 m where the reflectron voltage has been reduced to 7.5 kV so that the fragment ion is in focus. In this case the time of flight of the 1086.6 Da fragment is 48.155 μs, $\Delta TOF_f$ is 0.0176 μs and $\Delta TOF_p$ is 0.0018 μs so that $m_o$ is about 0.1 Da.

Figure 6:
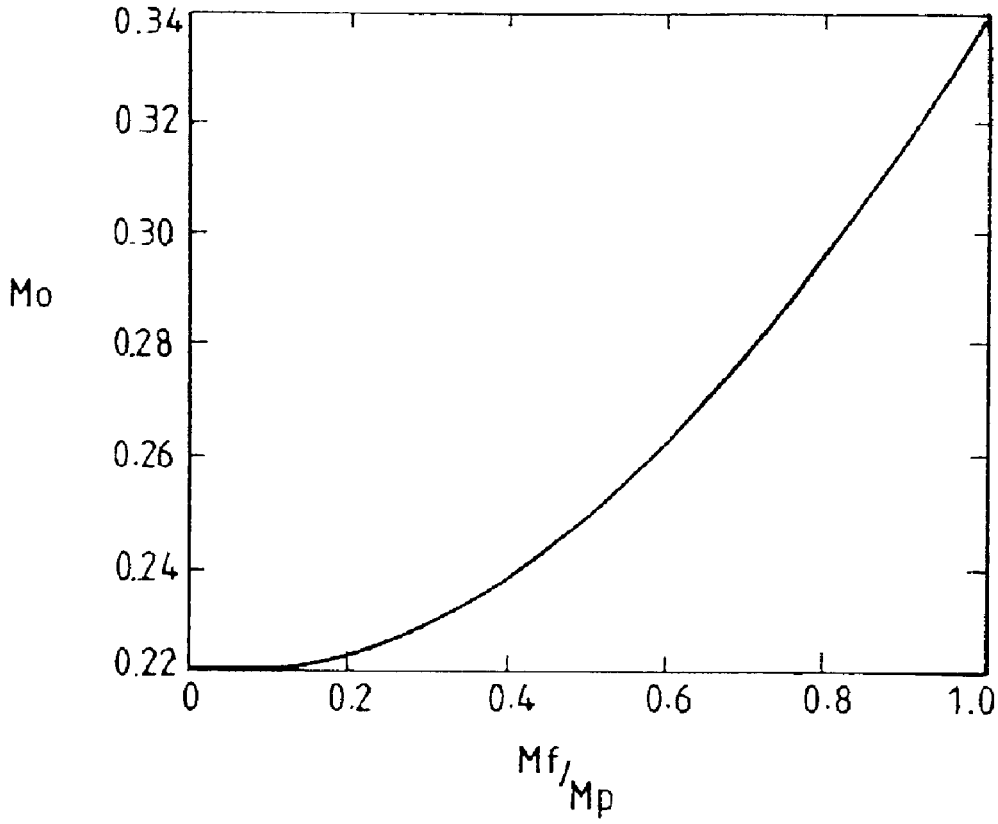
FIG. 6 is a graph showing the relationship between the mass offset parameter $m_0$ and $m_f/m_p$ (the ratio of actual fragment mass to precursor mass) in a curved field reflectron spectrometer.

The calculation can be extended to the whole fragment mass range and FIG. 6 shows a plot of $m_0$ as a function of $m_f/m_p$ for a curved field reflectron spectrometer. The plot was calculated using method 2 on a Math CAD package.

Figure 7A:
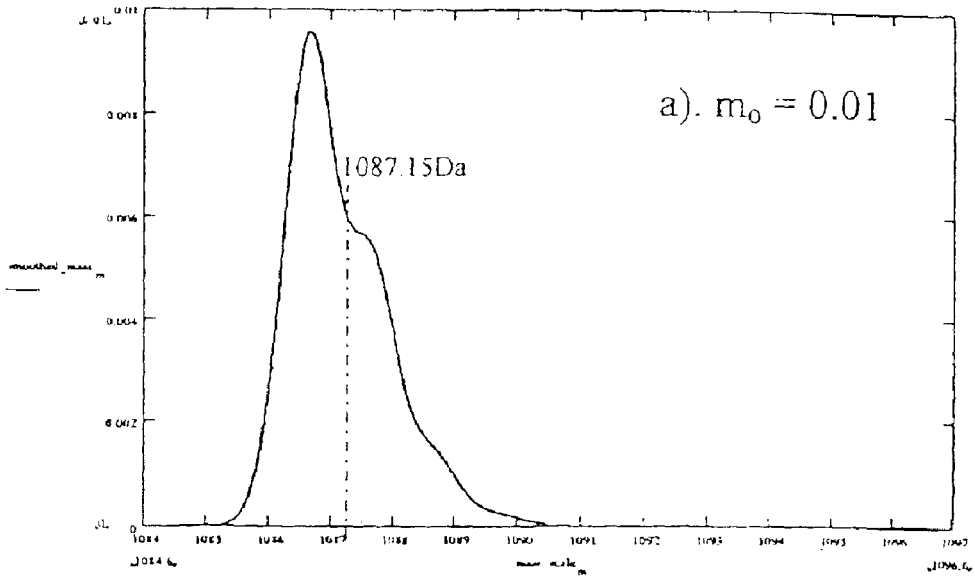
FIGS. 7*a* and 7*b* are a comparison of isotope distributions with different $m_0$ values.
Figure 7B:
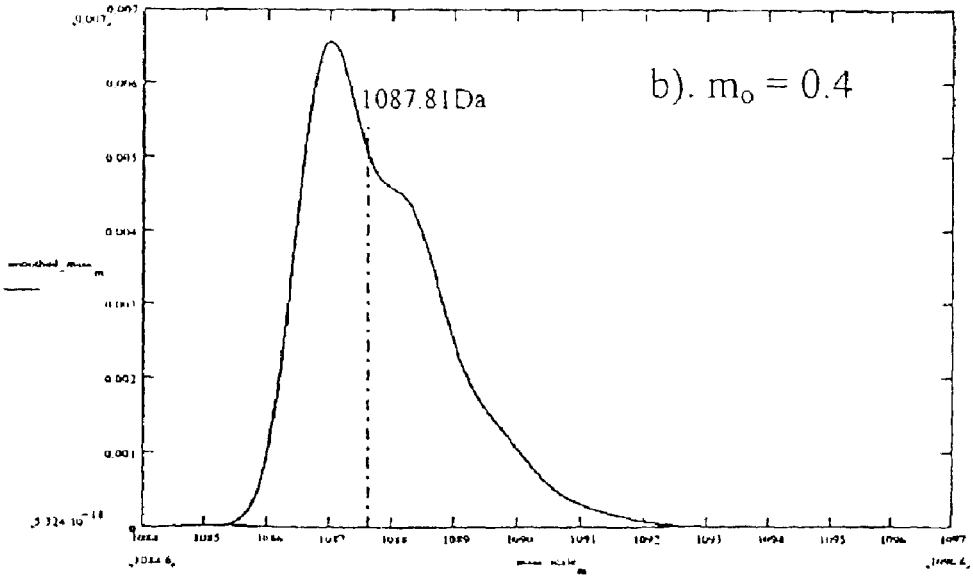

FIGS. 7*a* and 7*b* show two examples of how the average mass of a broad distribution is affected by the width of the distribution and how that in turn depends on $m_0$ for the mass distribution of the 1086.6 Da y9 fragment of Insulin B chain where FIG. 7*a* is for $m_0$ 0.01 Da (effectively zero) and FIG. 7*b* is for $m_0$=0.4 Da. These examples were both calculated using a computer program written by the author (as described in A R Bowdler, I Brookside, E Raptakis, 48th ASMS Conference on Mass Spectrometry and Allied Topics, June 2000). The shift in the average mass is apparent for the higher $m_0$. Whereas for $m_0$=0.01 the average mass is 1087.15 Da, when $m_0$=0.4 the average mass is 1087.81 Da, a shift of 0.66 Da. For the curved field reflectron example given previously $m_0$=0.24 the average mass is 1087.54 Da and in the case of the linear field reflectron where $m_0$=0.1 the average mass is 1087.3 Da.

Using the program to calculate the shift in average mass, $\delta m_{av}$ for different fragments produced by different parent ion, the author has discovered that for constant $m_0$, the shift in average mass is independent of the fragment mass. Furthermore, the mass shift depends on the value of $m_0$ and the number of carbon atoms, nCp in the parent ion such that:

$$\delta m_{av}=m_0\times(nCp/100).$$

So, for example, in the case of Angiotensin 2 peptide with an average parent ion mass of 1047.2 Da and 50 carbon atoms in the molecule, the fragment ions average mass will be measured high by 0.12 Da when $m_0$ is 0.24 Da. For Insulin B where the parent ion mass is 3497.96 Da and there are 157 carbon atoms in the molecule, the shift in average mass of the fragments will be just under 0.4 Da for the same $m_0$.

Any method which involves an average mass measurement must take into account the effect of the mass offset, $m_0$, in order to obtain the best mass accuracy. Two procedures which can do this are described below.

Method 1

Determine $m_0$ (if necessary as a function of $m_f/m_p$). This can be carried out by model and/or calculation using equations for the time of flight and dimensions of the mass spectrometer. This could also be carried out by measuring known samples and determining the separation of fragment isotopes (and subtracting 1 Da).

Determine by model and/or calculation the shift in average mass, $\delta m_{av}$, taking into account the spread in the fragment isotope distribution due to $m_0$. In other words determine the function $$\delta m_{av}=f(m_0, m_f, m_p).$$

This can also be carried out directly or determined empirically from a model and/or calculation using the equations for the time of flight and dimensions of the mass spectrometer.

Finally, subtract this value from the measured average mass determined in the experiment (on the unknown sample). The measured valued is obtained in the normal way, for example by centroiding.

Method 2

Measure the shift in the average mass, $\delta m_{av}$, over a range of known fragment masses and pre-cursor masses. In other words, make a calibration of the shift in average mass which defines the function $$\delta m_{av}=f(m_0, m_f, m_p).$$

Subtract the appropriate value of $\delta m_{av}$ from the measured average mass. The measured value is obtained in the normal way, for example by centroiding.

By correcting the measured average mass according to one of these methods, the accuracy of the calibration can be significantly improved.

Alternatively, the above methods can be used in conjunction with the mono-isotopic peak calibration method.

In this method the fragment ion calibration is carried out separately after the spectrometer has been calibrated for parent ions. A known compound which gives rise to e.g. ten known PSD fragments is analysed.

For each fragment ion the mono-isotopic peak (that is the peak corresponding to a mono-isotopic fragment ion) which has decayed from a mono-isotopic parent ion is determined. This may be done visually by inspection (i.e. by the mass spectrometer operator) or automatically by an algorithm built into the calibration software.

Once the mono-isotopic peak for each fragment has been selected it is used to calibrate the spectrometer for fragment ions using conventional methods. As the known compound gives rise to ten known fragment ions of known mass the spectrometer can be calibrated along the range of fragment to precursor ion mass ratios. It is important that it is the mono-isotopic peaks which are used as this avoids a mass offset error caused by the fact that each fragment ion could have decayed from one of several isotopic parent ions.

A suitable algorithm for selecting the mono-isotopic peak from the fragment isotopic peak distribution is described in the publication E J Breen, F G Hopwood, K L Williams, Mr Wilkins, Electrophoresis 2000, 21, 2243-2251. This algorithm uses the calculated isotope amplitude distribution to pick the mono-isotopic peak and is capable of doing so even when the isotopic peaks are not fully resolved. The algorithm assumes that the separation of the isotopic peaks is one Dalton and so will need to be adjusted by specifying that the separation is $(1+m_0)$ Daltons. $m_0$ is a mass offset parameter which depends upon the spectrometer and type of reflectron used.

Alterations and modifications to the above disclosure that fall within the scope of the present invention will be readily apparent to those skilled in the art.

What is claimed is:

1. A method of calibrating a reflectron time-of-flight mass spectrometer using a spectrum generated by fragment ions produced from parent metastable ion, comprising: modifying a measured mass value of a fragment ion to take into account the combined effect of natural isotope distribution of the parent metastable ion and post source decay on the mass separation of isotopic peaks in the fragment ion spectrum wherein the measured mass value which is modified is a measured average mass; and using the modified value for calibration.

2. A method according to claim 1, wherein the measured mass value which is modified is a measured average mass.

3. A method according to claim 1, wherein the measured mass value is modified by adjusting for the effect of a mass offset.

4. A method according to claim 3, wherein the effect of the mass offset is determined by constructing an ion trajectory model of a reflectron time-of-flight mass spectrometer and measuring time of flight of ions simulated in the model.

5. A method according to claim 3, wherein the effect of the mass offset is determined by calculating time of flight of different ions explicitly using equations of motion of ions in electric fields produced by a reflectron time-of-flight mass spectrometer.

6. A method according to claim 3, wherein the effect of the mass offset is calculated by measuring a shift in average mass over a range of known fragment masses and pre-cursor masses.

7. A method according to claim 1, wherein the modification is performed by subtracting a calculated value from the measured mass value.

8. The method according to claim 1, wherein a calibration function is determined using a sample of known molecular identity which undergoes post-source decay into fragment ions of known molecular identity.

9. A method of calibrating a reflectron time-of-flight mass spectrometer, comprising:

using a spectrum generated by fragment ions;

modifying a measured mass value to take into account an effect of post source decay; and using the modified value for calibration, wherein he measured mass value that is modified is a measured average mass.

10. A method of calibrating a reflectron time-of-flight mass spectrometer comprising: using a spectrum generated by fragment ions; modifying a measured mass value ion to take into account the effect of post source decay; using the modified value for calibration; determining the effect of a mass offset by constructing an ion trajectory model of a reflectron time-of-flight mass spectrometer and measuring time-of-flight ions simulated in the model; and modifying a measured mass value by adjusting for the effect of the mass offset, wherein the measured mass value which is modified is a measured average mass.

11. A method of calibrating a reflectron time-of-flight mass spectrometer, comprising:

using a spectrum generated by fragment ions;

calculating an effect of a mass offset by measuring a shift in an average mass over a range of known fragment masses and precursor masses;

modifying a measured mass value by adjusting for he effect of the mass offset to take into account an effect of a post source decay; and using the modified value for calibration.

* * * * *